US012234579B2

(12) United States Patent
Nusca

(10) Patent No.: US 12,234,579 B2
(45) Date of Patent: Feb. 25, 2025

(54) METHOD FOR THE TREATMENT OF VEGETABLE MATERIAL TO BE USED AS INFILL MATERIAL FOR SYNTHETIC AND/OR NATURAL TURFS

(71) Applicant: Roberto Nusca, San Giuliano Terme (IT)

(72) Inventor: Roberto Nusca, San Giuliano Terme (IT)

( * ) Notice: Subject to any disclaimer, the term of this patent is extended or adjusted under 35 U.S.C. 154(b) by 541 days.

(21) Appl. No.: 17/441,135

(22) PCT Filed: Mar. 20, 2019

(86) PCT No.: PCT/IT2019/000024
§ 371 (c)(1),
(2) Date: Sep. 20, 2021

(87) PCT Pub. No.: WO2020/188609
PCT Pub. Date: Sep. 24, 2020

(65) Prior Publication Data
US 2022/0162810 A1 May 26, 2022

(51) Int. Cl.
*D01G 13/00* (2006.01)

(52) U.S. Cl.
CPC ..... *D01G 13/00* (2013.01)

(58) Field of Classification Search
CPC ..... D01G 13/00
See application file for complete search history.

(56) References Cited

U.S. PATENT DOCUMENTS 10,358,745 B1 * 7/2019 Lim ..... D06B 23/026
2002/0081399 A1 6/2002 Prevost et al.
2004/0121114 A1 * 6/2004 Piana ..... D06M 11/70 427/372.2
2005/0087904 A1 * 4/2005 Bryan ..... B27N 3/28 264/211
2006/0059884 A1 * 3/2006 Zhou ..... D02G 3/02 57/252
2007/0248773 A1 10/2007 Nusca et al.
2014/0000761 A1 * 1/2014 Peng ..... D01C 1/00 144/3.1
2017/0081861 A1 * 3/2017 Song ..... B27K 3/44
2019/0040593 A1 * 2/2019 Tetrault ..... B32B 27/12
2019/0062998 A1 * 2/2019 Chen ..... D21H 27/10
2020/0017997 A1 * 1/2020 Kim ..... D01F 1/10
2021/0106040 A1 * 4/2021 Dietz ..... A21D 2/36
2021/0108000 A1 * 4/2021 Dietz ..... A23L 33/22
2022/0061623 A1 * 3/2022 Henri ..... C11D 17/049

FOREIGN PATENT DOCUMENTS

EP 3 336 252 A1 6/2018
GB 814885 6/1959

OTHER PUBLICATIONS

International Search Report, dated Jan. 2, 2020, corresponding to PCT/IT2019/000024.

* cited by examiner

*Primary Examiner* — Bao-Thieu L Nguyen
(74) *Attorney, Agent, or Firm* — Ladas & Parry LLP; Malcolm J. MacDonald, Esq.

(57) ABSTRACT

Method for the treatment of loose material of vegetable origin to be used as infill material (10) in artificial, or natural, or mixed artificial and natural turfs (1), comprising a step of mixing a predetermined amount of loose material of vegetable origin with a predetermined amount of a predetermined compound based on at least a drying, or semi-drying oil, in such a way to improve its properties.

18 Claims, 6 Drawing Sheets

Fig. 4
Fig. 3
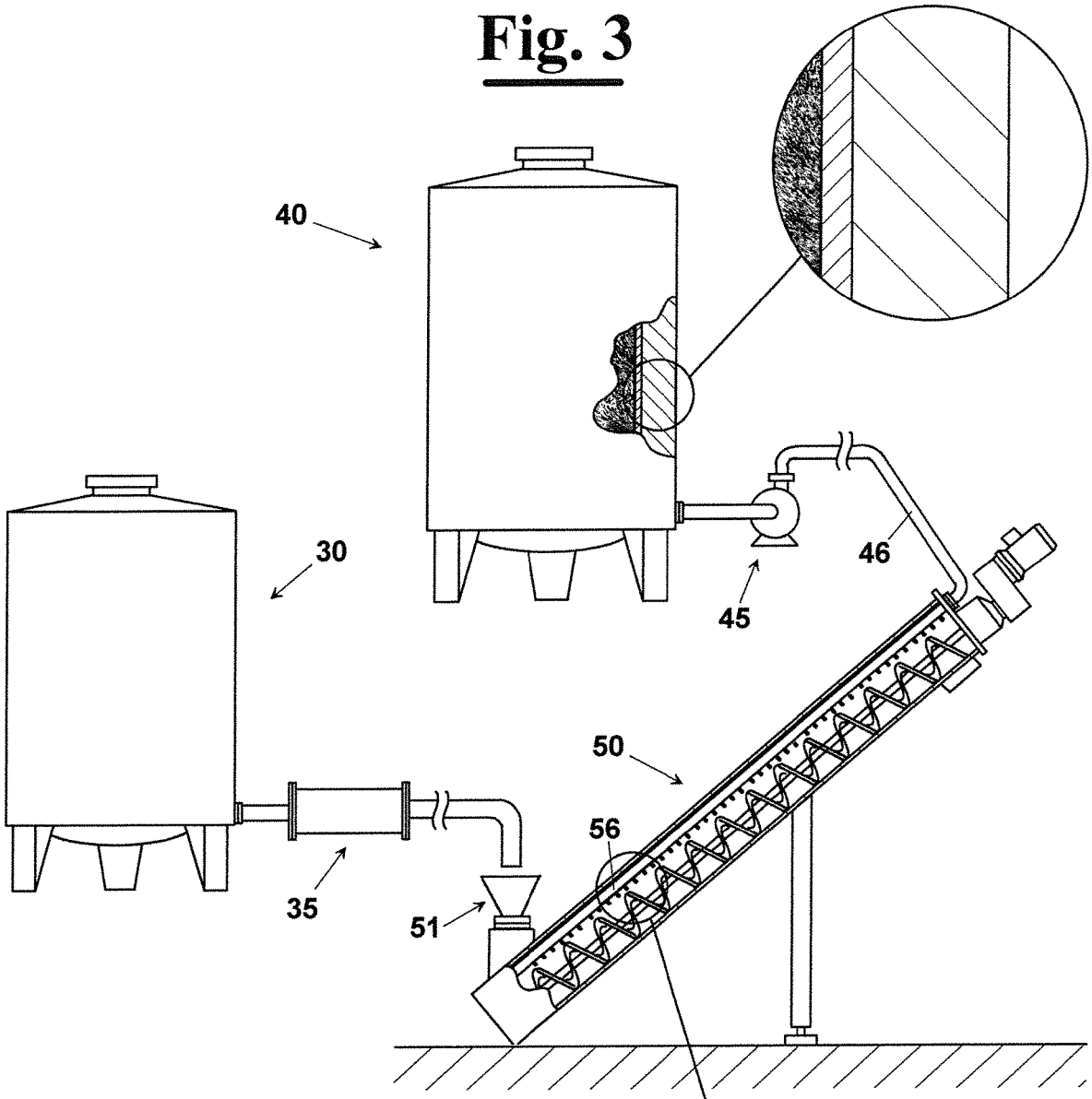
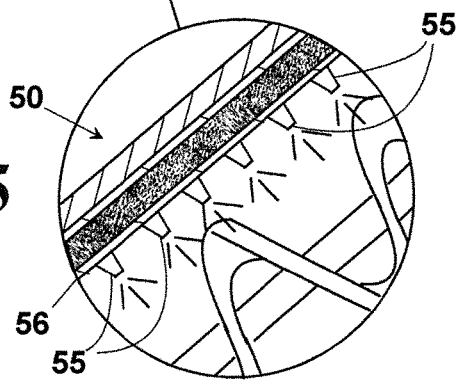
Fig. 5

30a
35a
81a
30b
80
81b
35b
81c
30c
35c
82
51
50
40
45
300

METHOD FOR THE TREATMENT OF VEGETABLE MATERIAL TO BE USED AS INFILL MATERIAL FOR SYNTHETIC AND/OR NATURAL TURFS

FIELD OF THE INVENTION

The present invention relates to a method for the treatment of vegetable material to be used as infill material in artificial and/or natural and artificial turfs.

The invention also relates to an artificial and/or natural turf obtained using the above disclosed infill material.

DESCRIPTION OF THE PRIOR ART

As known, an artificial turf essentially consists of a mat made of plastic material to which blades, also called "bristles", which are made of synthetic material, are fixed in such a way to form an artificial turf. The blades made of synthetic material are knitted to the mat by means of known processes that allow to obtain a warp of blades, which are close to each other according to the needs.

Hybrid turfs are also known, that means comprising both the aforementioned blades made of synthetic grass and blades made of natural grass obtained from at least a vegetable species, and that form a natural grass turf. In this way, a turf is obtained having an appearance that is very similar to that of natural grass turfs, but with special properties, in particular because they are able to resist to adverse climatic conditions. An example of this type of hybrid turf is described in EP1781859.

Both in the case of artificial turf and hybrid artificial and natural turf, all around the blades made of synthetic material, and the natural blades of grass if they are present, an infill material, also simply called "infill", is distributed. This is, usually, granular-shaped, and is chosen both according to the kind of aim to which it is destined, i.e. if for ornamental or sportive purposes, and on the basis of the kind of sport to which the artificial turf is destined, as for example soccer, hockey, cricket, rugby, but also according to the weather conditions that are more frequent where the artificial turf is installed.

The infill material provides a draining action by adjusting the drainage of rainwater or irrigation water, protects the mat assuring to the artificial turf a high duration in the time, and first of all confers to the turf mechanical, physical and technological features similar to those of the natural turf. The most important features of an infill material are, in particular, the elasticity of the ground for the user, the rebound of the ball, the capacity of absorption of the hits when falling down, tensile and torque resistance to the force caused by the shoe, the resistance against compression, and penetration of external bodies, as well as the capacity of absorption and drainage of water in case of meteorological and environmental events.

The drainage action of the artificial turf is, usually, carried out by a base portion, or "stabilizing infill", essentially constituted of sand. Instead, the elasticity of the artificial turf is, usually, guaranteed by the presence of granules of rubber that are concentrated in the upper portion of the turf, or "performance infill". An example of a similar infill material is disclosed in US2002/081399.

However, the artificial turfs of known type, in particular if they contain rubber and sand, have many drawbacks. Firstly, owing to the compression caused by trampling, or by settling of the drainage water percolation, eventually the layer of sand tends to become compacted thus losing its drainage properties. Therefore, in particular in case of abundant rainfall, the artificial turf cannot drain away the rain water and is subjected to flooding. This causes a random and turbulent mixture of the infill material, in particular at the upper layers of the same, that is, therefore, removed from the correct position within the infill. In particular, the infill material, in the time, shows zones where the material dragged by water concentrates, and other zones, instead, completely, or however impoverished of the same material. Therefore, the artificial turf loses its original structure and, accordingly, the physical, mechanical and drainage features that it had at the moment of laying.

Another drawback of the artificial turfs of prior art, especially in the hottest seasons, is that they heat quickly and reach temperatures above 60° C., with consequent troubles to the athletes if compared with natural turf. This inconvenience is particularly felt in the countries with a very high average temperature practically all the year. For this reason, the artificial turf of prior art must be periodically irrigated in order to avoid as much as possible the above disclosed overheating of the artificial turf with consequent high consumption of time and waste of water. Furthermore, the above disclosed irrigation and drainage cycles of the infill tends, in the time, to compact the lower layers that, therefore, as above explained, shows an even less effective drainage action.

Another drawback of the infills of prior art is that, during the periods of the year in which the temperatures are very low, or in the countries where the temperatures drop below −10° C., till −20° C., for a great part of the year, the infill material can freeze thus losing the desired properties of the material, not least the drainage effectiveness.

A further drawback of the infills of prior art is that, mainly owing to the presence of determined materials, in particular rubber, but also owing to the presence of the blades made of synthetic materials, the turfs of prior art can burn and the flames spread very quickly causing a fire, which destroys the turf very quickly, besides producing environmental impact problems owing to the smoke.

SUMMARY OF THE INVENTION

It is therefore an object of the present invention to provide a method for the treatment of vegetable material to be used as infill material in artificial, or mixed artificial/natural, or natural, turfs that is able to overcome the above disclosed drawbacks of the infill materials of prior art.

It is, in particular, an object of the present invention to provide a method for the treatment of vegetable material that allows to obtain a water-repellent infill material, in such a way to avoid that, in case of abundant rainfall the turf in which the same is utilized, can be subjected to flooding.

It is another particular object of the present invention to provide a method for the treatment of vegetable material that allows to obtain an infill material which does not freeze and that is able to remain in the form of loose material also at temperatures of about −30° C.

It is also an object of the present invention to provide a method for the treatment of vegetable material that allows to obtain a fireproof material, which does not produce open flames and that has self-extinguishing properties.

It is also an object of the present invention to provide a plant for the treatment of vegetable material to be used as infill material in artificial, or mixed artificial/natural turfs having the same advantages.

It is finally an object of the present invention to provide an artificial, or mixed artificial/natural, turf having the aforementioned advantages with respect to the turfs of prior art.

These and other objects are achieved by a method for the treatment of loose material of vegetable origin to be used as infill material in artificial, or natural, or mixed artificial and natural, turfs whose main characteristic is to provide a step of mixing a predetermined amount of the aforementioned loose material of vegetable origin with a predetermined amount of a predetermined compound based on at least a drying, or semi-drying oil, in order to improve the properties of the loose material of vegetable origin.

In particular, it has been observed that the aforementioned mixing allows to make the loose material of vegetable origin water-repellent. More in particular, the loose material of vegetable origin, having a determined porosity, absorb the above disclosed drying, or semi-drying oil, which, therefore, penetrates in the structure of the material, avoiding that the same can significantly absorb water, or humidity. Therefore, the use of this product as infill material of artificial, or mixed artificial-natural, turfs allows to avoid that rain water, or irrigation water, can be retained by the vegetable material, thus causing flooding of the field, and considerably improving its drainage capacities.

Another property of vegetable material that is improved with the aforementioned mixture of drying, or semi-drying oil, is to be able to lower the freezing temperature. In fact, it has been noted that, unlike vegetable material that is not mixed with drying, or semi-drying oil, the material does not freeze significantly up to temperature of about −25° C., −30° C. and practically remain a loose product, i.e. it does not compact.

In addition to the above, it has been demonstrated that mixing the loose material of vegetable origin with the drying, or semi-drying, oil, allows to develop anti-flame and self-extinguishing properties of the loose material of vegetable origin, through which, therefore, open flames cannot spread, and quickly extinguish.

Further features and related embodiments of the invention are set out in the dependent claims.

In particular, the above disclosed compound based on at least said, or each, drying, or semi-drying oil, can be a stand-oil obtained by subjecting said, or each drying, or semi-drying oil, to a thermic treatment which provides to heat said, or each, drying, or semi-drying oil, up to reach a predetermined temperature T*, in particular in the absence of air, in such a way to cause the, or each, drying, or semi-drying oil to polymerize in order to increase its stability. For example, the above disclosed temperature T* can be higher than 200° C., advantageously higher than 250° C.

Advantageously, the drying oil can be selected from the group consisting of linseed oil, walnut oil, poppy oil, or sunflower oil, or a combination thereof.

According to another aspect of the present invention, an artificial turf, or mixed artificial and natural turf, comprises:

- a base mat having a first face and a second face opposite to the first face;
- a plurality of blades made of synthetic material fixed to said mat;
- an infill material distributed on said second face of said base mat, said infill material comprising a predetermined amount of a compound based on at least a drying, or semi-drying oil, mixed with a predetermined amount of a loose material of vegetable origin.

According to a further aspect of the invention, a plant for the treatment of loose material of vegetable origin to be used as infill material in artificial, or mixed artificial and natural, turfs provides a mixing device configured to mix a predetermined amount of said loose material of vegetable origin with a predetermined amount of a predetermined compound based on at least a drying, or semi-drying oil, in such a way to improve the properties of said loose material of vegetable origin.

BRIEF DESCRIPTION OF THE DRAWINGS

The invention will now be shown with the following description of its exemplary embodiments, exemplifying but not limitative, with reference to the attached drawings in which:

FIG. 3 diagrammatically shows a side elevational view of a first alternative embodiment of the plant of FIG. 2 for the treatment of vegetable material to be used as infill material in artificial, or mixed artificial/natural turfs;

FIG. 4 diagrammatically shows an enlargement of a section of a reservoir that can be used in the plant of FIG. 2, or 3, for storing the compound based on a drying, or semi-drying oil according to the invention;

FIG. 5 shows an enlargement of a longitudinal section of a possible mixing device that can be used in the plant of FIG. 4;

FIGS. from 10 to 12, respectively, diagrammatically shows a cross-section view of two possible embodiments of an artificial, or mixed artificial/natural turf that can be made with the infill material obtained by the method according to the invention.

DETAILED DESCRIPTION OF SOME EXEMPLARY EMBODIMENTS OF THE INVENTION

Figure 1:
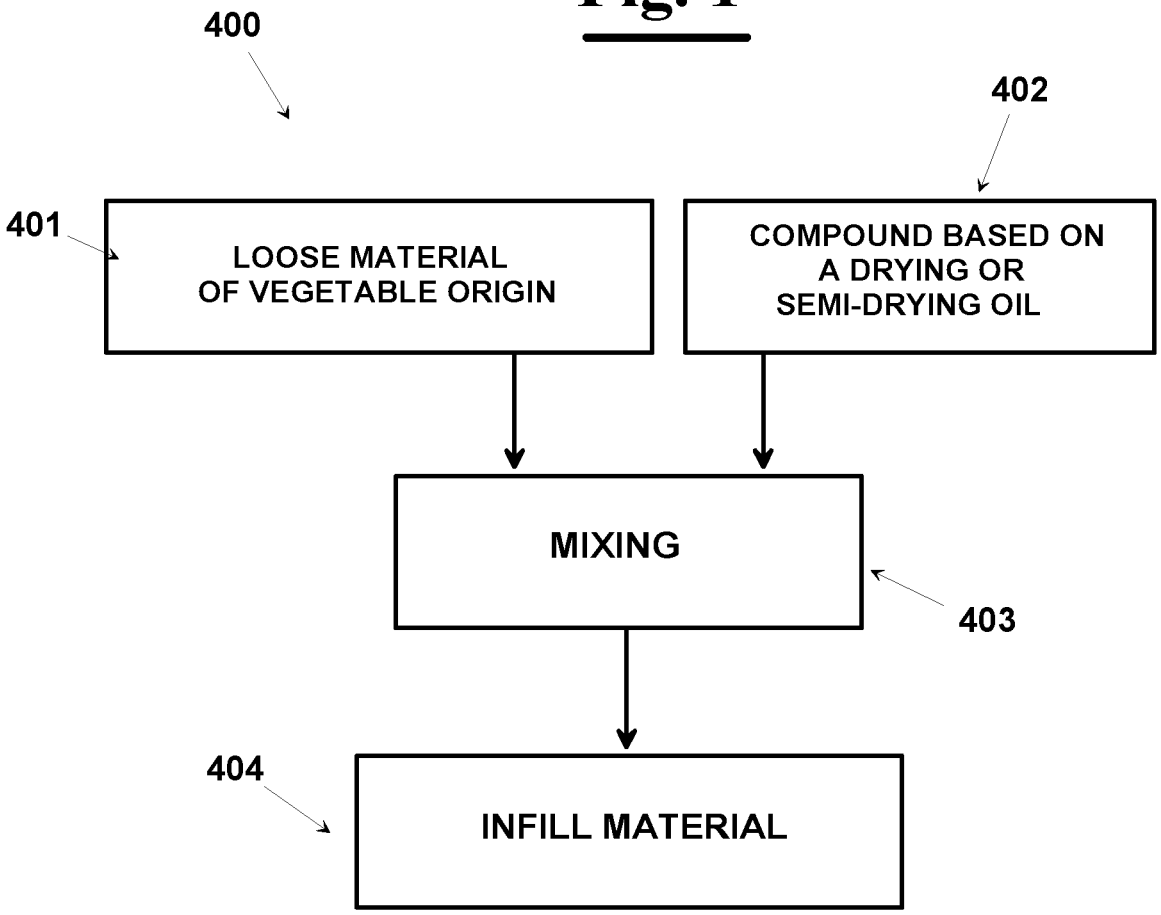
FIG. 1 diagrammatically shows a block diagram of a possible embodiment of a method for the treatment of vegetable material to be used as infill material in artificial, or natural, or mixed artificial/natural turfs, according to the invention.

With reference to the block diagram 400 of FIG. 1, the method, according to the invention, for the treatment of loose material of vegetable origin to be used as infill material in artificial, or natural, or mixed artificial and natural turfs, provides a step of mixing, block 403, a predetermined amount of a loose material of vegetable origin, block 401, with a predetermined amount of a predetermined compound based on at least a drying, or semi-drying oil, block 402. In this way a mixture is obtained that can be used as infill material for artificial, or mixed artificial and natural turfs, block 404. Advantageously, the mixing step can provide to mix an amount comprised between 50 and 200 g of the aforementioned compound based on drying, or semi-drying oil, for each litre, or $dm^3$, of the aforementioned loose material of vegetable origin.

In particular, the above disclosed compound based on at least a drying, or semi-drying oil, can be a stand-oil. More in particular, stand-oil can be obtained by subjecting at least a drying, or semi-drying oil, to a thermic treatment, which provides to heat the starting drying, or semi-drying oil, up to a predetermined temperature I*, advantageously greater than 200° C., preferably greater than 250° C., for example comprised between 280° C. and 320° C., in such a way to cause the, or each, compound based on drying, or semi-drying oil to polymerize thus increasing its stability. In a possible advantageous embodiment of the invention, the above disclosed heating is carried out in the absence of air. In particular, the drying oil can be selected from the group consisting of: linseed oil, walnut oil, poppy oil, sunflower oil, or a combination thereof.

In a first embodiment of the invention, a plant 100 for the treatment of loose material of vegetable origin to be used as infill material in artificial, or mixed artificial and natural turfs, provides at least a first reservoir 30 containing the above disclosed loose vegetable material, and at least a second reservoir 40 containing the above disclosed compound based on drying, or semi-drying oil. More in particular, a first and a second transfer device 35 and 45 can be provided configured to respectively transfer the loose vegetable material and the compound based on drying, or semi-drying oil, from the first reservoir 30, and from the second reservoir 40, respectively, to the mixing device 50. In a first embodiment of the invention, the transfer device 35 can be a conveyor belt, or a chute, or a pump for powder, for example a pneumatic pump, or an archimedean screw arranged to transfer the loose material within the mixing device 50 for example by means of a hopper 51. The transfer device 45 can be, instead, a volumetric pump. More in particular, the transfer device 35 and the transfer device 45 can provide respective flow measurement devices, not shown in figure for reasons of simplicity, in such a way to be able to transfer known amount of loose vegetable material and of the aforementioned compound based on drying, or semi-drying oil, from the first reservoir 30 and from the second reservoir 40 within the mixing device 50. This is arranged to mix the loose vegetable material with the compound based on drying, or semi-drying oil, in such a way to obtain a product that can be used as infill material.

Figure 2:
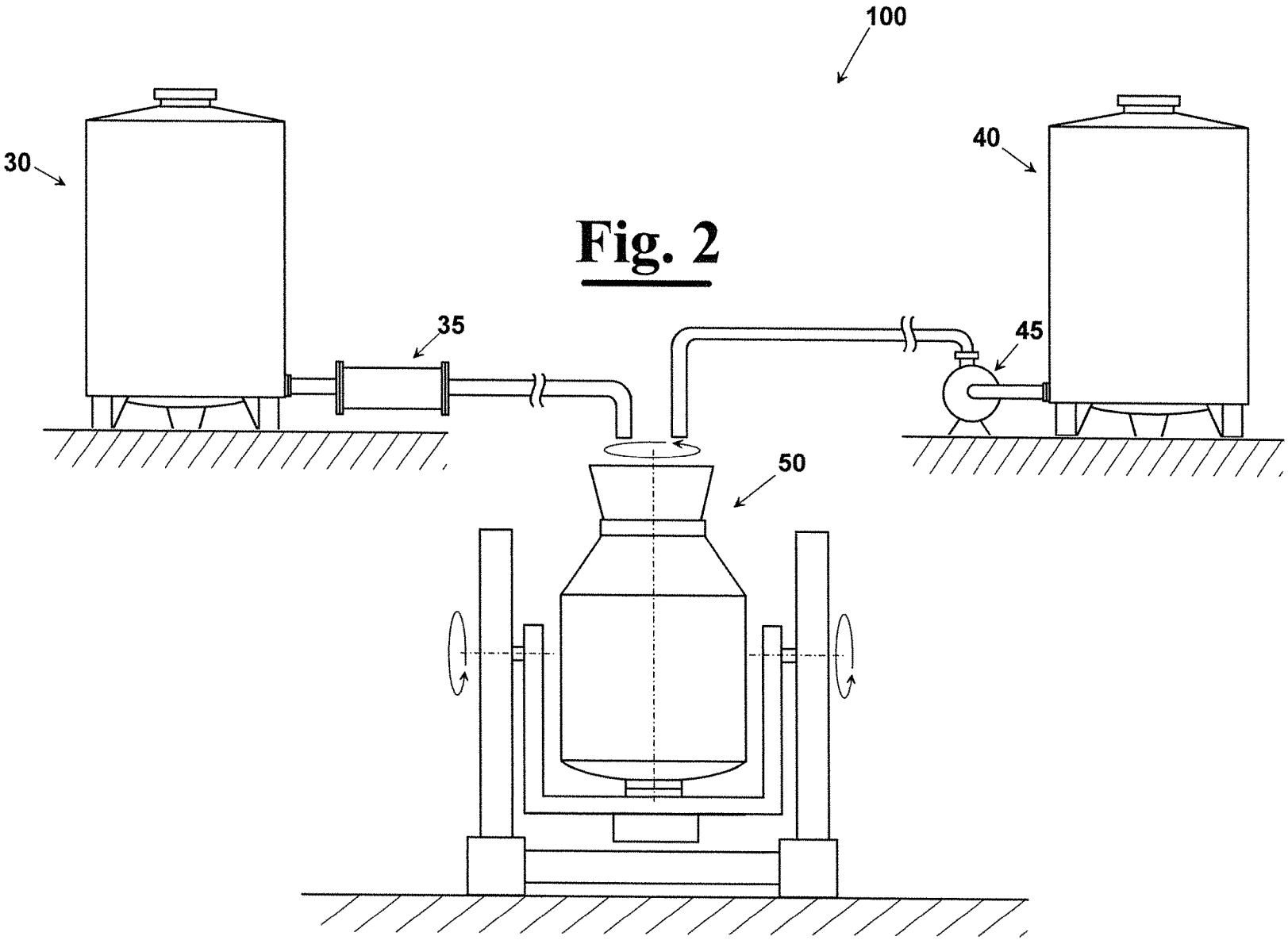
FIG. 2 diagrammatically shows a side elevation view of a first embodiment of a plant for the treatment of vegetable material to be used as infill material in artificial, or natural, or mixed artificial/natural turfs, according to the invention.
Figure 6:
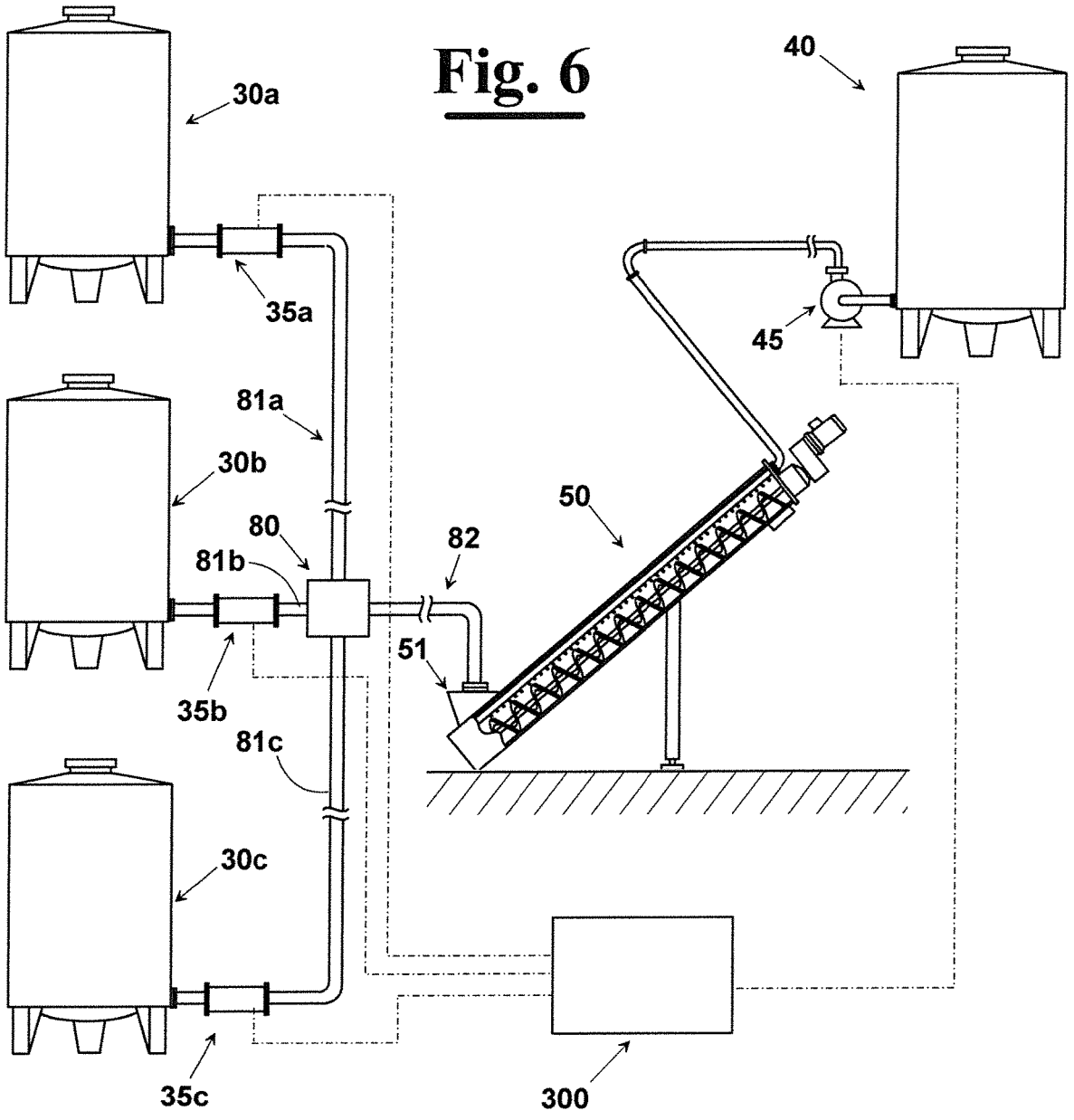
FIG. 6 diagrammatically shows a side elevation view of another alternative embodiment of the plant of FIG. 2 for the treatment of vegetable material to be used as infill material in artificial, or mixed artificial/natural turfs.
Figure 7:
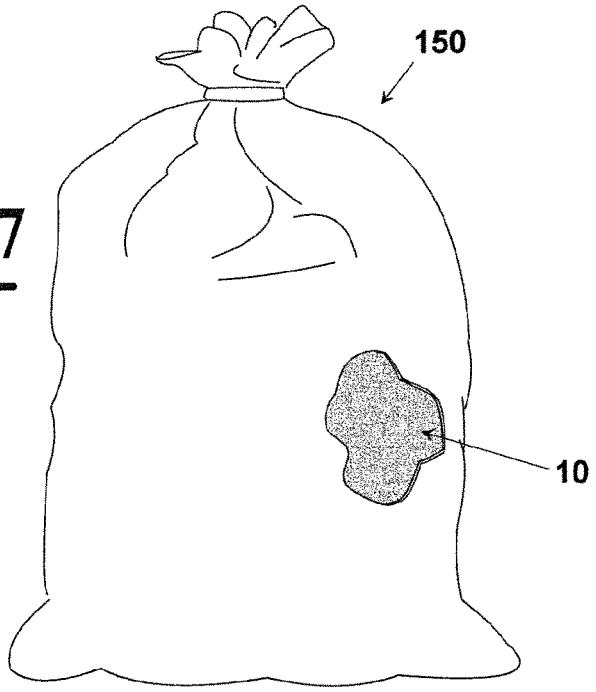
FIG. 7 diagrammatically shows a perspective front view with a part removed, of a possible embodiment of a sack containing a mixture, according to the invention, that can be used for producing an infill material for an artificial, or mixed artificial/natural turf.
Figure 9:
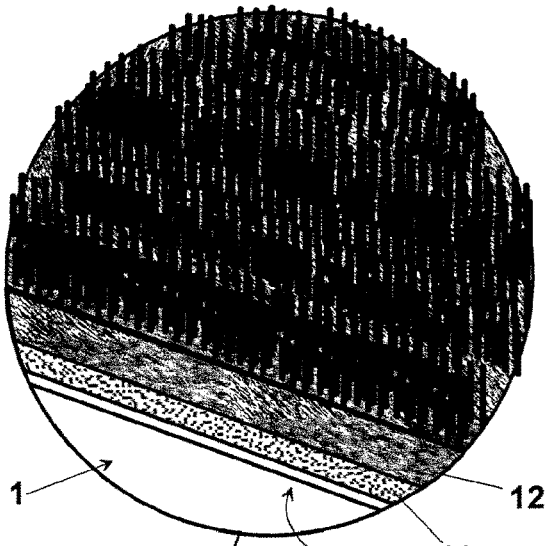
FIG. 9 shows an enlargement of the turf of FIG. 8.

As shown in FIG. 2, the mixing device can be a rotating, and in case also oscillating, drum mixer. However, the mixing device can be also of different type. For example, as diagrammatically shown in the alternative embodiment of FIG. 3, the mixing device 50 can be a screw mixer.

Advantageously, the distribution step of the above disclosed compound based on at least a drying, or semi-drying oil, can provide a nebulization step of the same. In particular, the nebulization of the compound based on drying, or semi-drying oil, can be carried out within the mixing device 50. More in particular, in the example of FIG. 5 the nebulization is obtained by forcing the compound based on drying, or semi-drying oil, to pass through at least a supply nozzle, advantageously through a plurality of supply nozzles 55. These can be made at a duct 56, which longitudinally passes through the mixing device 50, in which the compound is introduced through a duct 46 communicating with the transfer device 45. The nebulized compound is, then, sprayed on the loose material of vegetable origin through the, or each, supply nozzle 55 and mixed by the above disclosed screw mixer (see FIGS. 3 and 5).

In particular, the, or each, aforementioned reservoir 40, can contain a predetermined amount of a loose product obtained from raw material based on ground coconut. Alternatively, the, or each, aforementioned reservoir 40, can contain a loose product obtained from raw material based on cork. In another embodiment provided, the, or each, aforementioned reservoir 40, can contain rachis of cereal ear, advantageously maize-cob, which is rachis of maize. Still in another embodiment, the, or each, aforementioned reservoir 40 can contain cereal husks, in particular selected from the group consisting of rice husks, wheat husks, rye husks, oat husks, spelt husks, or a combination thereof. In a further embodiment of the invention, the, or each, aforementioned reservoir 40 can contain a mixture of the aforementioned materials, or of some of them. For example, the, or each, aforementioned reservoir 40 can contain a mixture of a loose product obtained from raw material based on ground coconut, with a loose product obtained from raw material based on cork, with rachis of cereal ear, with rachis of maize, with cereal husks. Mixing in the aforementioned ratio between weight of compound based on drying oil and volume of loose material of vegetable origin can be obtained by measuring the amount of components by means of the aforementioned transfer devices 35 and 45. More in particular, the transfer devices 35 and 45 are arranged to feed predetermined flows, respectively, of loose material of vegetable origin from reservoir 30, and of compound based on drying, or semi-drying oil, from reservoir 40, to the aforementioned mixing device 50.

In particular, the above disclosed reservoir 40, which contains the compound based on at least a drying, or semi-drying oil, can be insulated in such a way to avoid that the product that is contained in the same may be subject to significant variations in temperature, in particular that is subjected to a temperature reduction. More in particular, the reservoir 40 can be insulated in such a wat that the above disclosed compound based on at least a drying, or semi-drying oil, remains at a predetermined temperature, advantageously higher than 70° C., for example at a temperature between 70 and 100° C., advantageously comprised between 80° C. and 95° C.

In a possible embodiment according to the invention and diagrammatically shown in FIG. 5, a plurality of reservoirs 30 is provided, for example 4 reservoirs 30*a*-30*d*, each of which arranged to contain a predetermined type of loose material of vegetable origin. In particular, each reservoir 30*a*-30*d* can be associated to a transfer device 35*a*-35*d* arranged to transfer a determined loose vegetable material within the mixing device 50. More in particular, a selection device 80 can be provided arranged to selectively open, or close, one, or more branches 81*a*-81*c*, respectively connected to reservoirs 30*a*-30*c* and to selection device 80 in such a way to put them in communication with, or disconnect them from, a branch positioned downstream 82 through which the loose material is introduced into the mixing device 50.

For example, the first reservoir 30*a* can contain a loose material based on coconut, the second reservoir 30*b* can contain raw material based on cork, the third reservoir 30*c* can contain rachis of cereal ear, for example maize-cob, and the fourth reservoir 30*d* can contain cereal husks, for example rice husks. In particular, the raw material based on coconut, advantageously ground, can comprise the only fibrous part of a starting product based on coconut. More in particular, the above disclosed loose product obtained from raw material based on coconut can be obtained by subjecting said starting product based on coconut to a separation step configured to divide a powder part having a granulometry smaller than 500 μm, which is discharged, from a fibrous part, having a granulometry greater than 500 μm which is used as the above disclosed loose product based on coconut. For example, the aforementioned separation step can be carried out by a vibrating sieve. In particular, during the aforementioned separation step the humidity of the product based on coconut can be adjusted, in such a way that the humidity value μ of the same is less than, or equal to, 10%, i.e. $0<\mu<10\%$.

Figure 8:
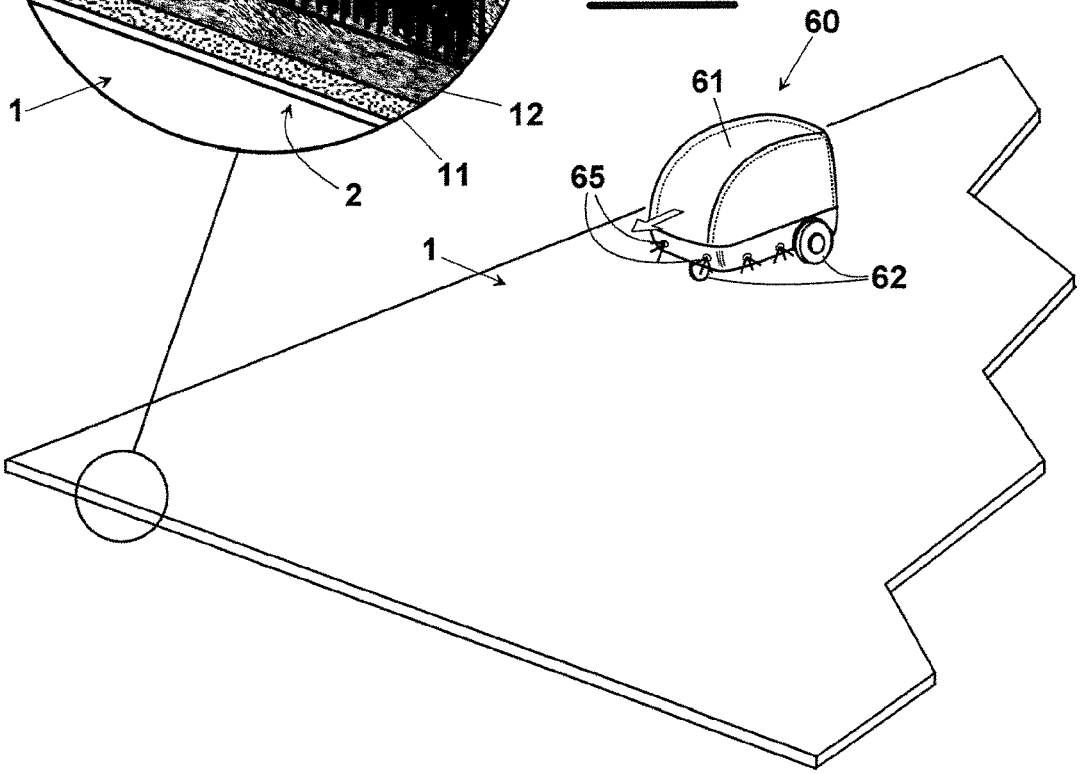
FIG. 8 diagrammatically shows a possible embodiment of a step of distribution of the compound based on drying, or semi-drying oil, on the turf that is already put in place.
Figure 10:
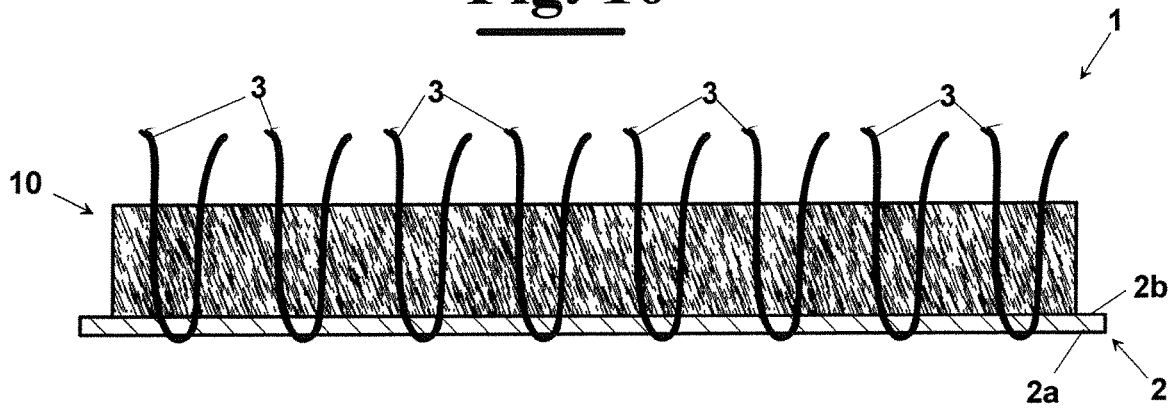

According to an embodiment of the present invention, according to the type of desired mixture, determined amount of two, or more, of the aforementioned loose materials of vegetable origin, are mixed together. This can be obtained setting, for example by a control unit 300, a determined mixture between a plurality of possible mixtures and operating by the control unit 300 same a determined number of transfer devices, in order to feed a corresponding amount of each loose material of vegetable origin to a mixing device. Within the mixing device, the aforementioned mixture can be, furthermore, mixed with a predetermined amount of the aforementioned compound based on drying, or semi-drying oil, in order to confer to the same the aforementioned water-repellent, flame retardant, and reduction of freezing temperature properties. For example, amount of cereal husks, of product based on coconut, and cork, can be fed into the mixing device 50 in such a way to have inside the aforementioned mixing device a mixture having the following composition: between 65% and 75% of the aforementioned loose product a based on coconut coming from the first reservoir 30*a*, between 20 and 25% of loose material based on cork coming from the second reservoir 30*b*, and between 1 and 15% by weight of cereal husks, in particular rice husks, coming from the fourth reservoir 30*d*. In a possible alternative embodiment of the invention, diagrammatically shown in FIG. 8, the above disclosed compound based on at least a drying, or semi-drying oil, can be distributed on an artificial, or mixed artificial-natural turf, after that the turf is laid down. In particular, the aforementioned distribution step can be carried out by a distribution device 60 that is able to move on turf 1, for example by wheels 62. The distribution device 60 can be provided with at least a supply nozzle 65, advantageously a plurality of supply nozzles 65 arranged to supply a predetermined amount of compound per $m^2$ of swept surface. The distribution device can be furthermore provided with a displacement element, not shown in the figure for reasons of simplicity, that is able to move the infill material in order to mix the same with the distributed compound. For example, as diagrammatically shown in FIG. 8, the above disclosed compound can be contained within a reservoir 61, advantageously an insulated reservoir, of which the distribution device 60 is provided. In an alternative embodiment, not shown in the figures for reasons of simplicity, the reservoir 61 can be mounted on a carriage, which is engaged, free to slide, on at least a guide configured in such a way to allow the aforementioned reservoir to cover the whole surface of turf 1.

Figure 11:
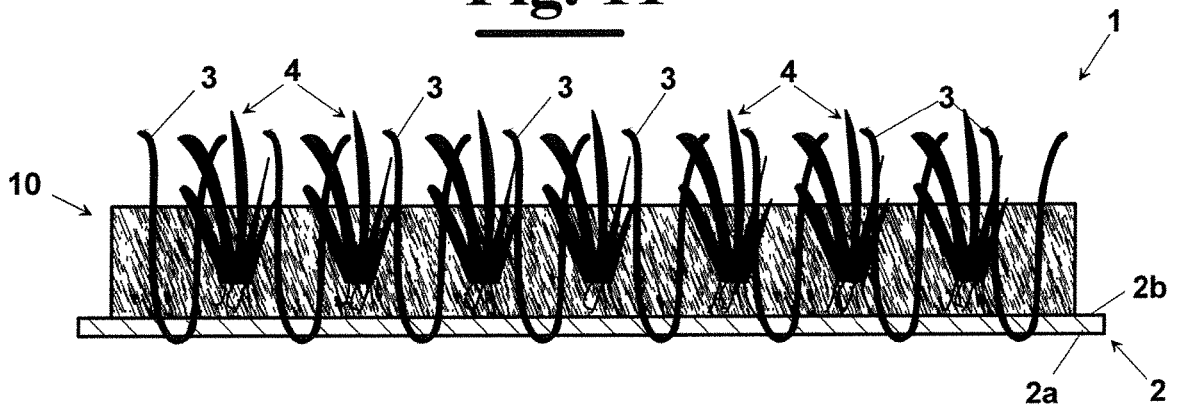
Figure 12:
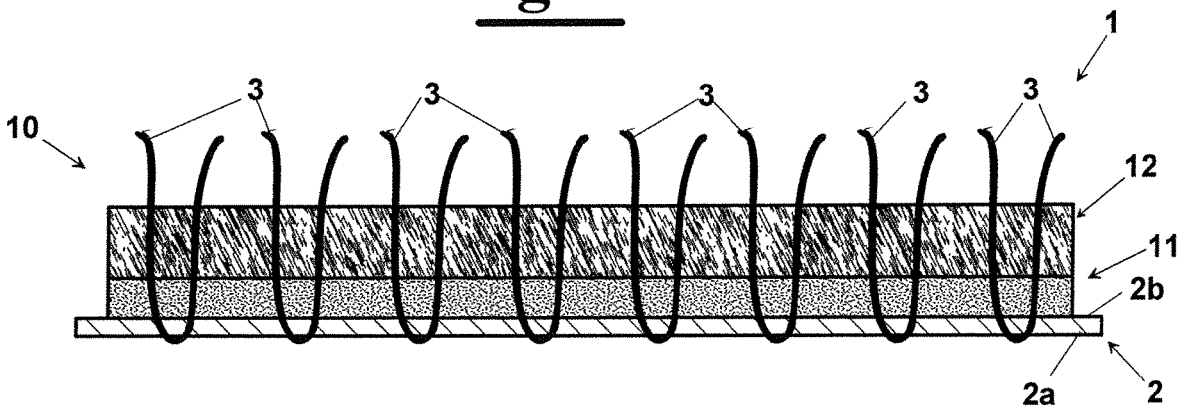

In particular, as diagrammatically shown in the figures from 9 to 12, the above disclosed turf 1 to which the infill material 10 is destined, can provide a mat 2, having a face 2*a*, which, in use, is positioned adjacent to a surface to be covered, and a face 2*b* opposite to face 2*a*. Turf 1, furthermore, comprises a plurality of blades, or bristles, 3 made of synthetic material that are fixed to mat 2, for example by gluing, or sewing. In the case of the mixed artificial-natural turf, in addition to the blades made of synthetic material, on the mat 2 a turf of natural grass 4 is also present that is obtained by at least a vegetable species can root at least in part above the mat 2 (see FIG. 11). On face 2*b* of mat 2 is, furthermore, present an infill material 10 positioned between the vegetable species and/or the blades 3 made of synthetic material. In particular, the infill material 10 can be constituted only of raw material based on ground coconut. More in particular, at least 90% by volume of the raw material based on ground coconut is constituted of fibrous part of a product based on the starting coconut. Advantageously, at least 90% by weight of the above disclosed raw material based on coconut has a granulometry higher than 500 μm.

Alternatively, the infill material 10 can have the following composition by volume: between 1% and 15% of cereal husks, between 20% and 35% of raw material based on cork and between 55% and 80% of raw material based on ground coconut. In an alternative embodiment, the infill material 10 comprises between 5% and 90% by weight of rachis of cereal ear and the remaining part of raw material based on ground coconut.

In an embodiment provided by the invention, the infill material 10 can provide a lower portion, or stabilization infill 11, and an upper portion, or performance infill 12 positioned above the stabilization infill 11. In particular, the stabilization infill 11 can be constituted, or comprise sand and the performance infill 12 can have one of the compositions aforementioned.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A method for the treatment of loose material of vegetable origin to be used as infill material in artificial, or natural, or mixed artificial and natural turfs, said method comprising:

mixing a predetermined amount of said loose material of vegetable origin with a predetermined amount of a predetermined compound based on a drying, or semi-drying oil, in such a way to improve the properties of said loose material of vegetable origin;

wherein said mixing step provides mixing an amount comprised between 50 g and 200 g of said compound based on drying or semi-drying oil, for each cubic decimeter of loose material of vegetable origin.

2. The method according to claim 1, wherein said compound based on said, or each, drying, or semi-drying oil, is a stand-oil is obtained by subjecting said, or each drying, or semi-drying oil, to a thermic treatment, which provides to heat said, or each, drying, or semi-drying oil, up to a predetermined temperature, in such a way to cause said, or each, drying, or semi-drying oil to polymerize in order to increase its stability.

3. The method according to claim 1, wherein said thermic treatment provides to heat in the absence of air said, or each drying, or semi-drying oil, up to a predetermined temperature higher than 200° C.

4. The method according to claim 1, wherein said drying oil is selected from the group consisting of:
linseed oil;
walnut oil;
poppy oil;
sunflower oil; and
a combination thereof.

5. The method according to claim 1, wherein a nebulization step is provided of said compound based on a drying, or semi-drying oil, obtained by forcing said compound based on a drying, or semi-drying oil, to pass through a supply nozzle, and to spray said nebulized compound on said loose material of vegetable origin through said, or each, supply nozzle.

6. The method according to claim 1, wherein said mixing step is carried out in a screw mixer.

7. The method according to claim 1, wherein said loose material of vegetable origin comprises a predetermined amount of a loose product obtained from raw material based on ground coconut.

8. The method according to claim 1, wherein said loose material of vegetable origin comprises a predetermined amount of a loose product obtained from raw material based on cork.

9. The method according to claim 1, wherein said loose material of vegetable origin comprises a predetermined amount of rachis of cereal ear.

10. The method according to claim 9, wherein said rachis of cereal ear is maize-cob, which is rachis of maize.

11. The method according to claim 1, wherein said loose material of vegetable origin comprises a predetermined amount of cereal husks.

12. The method according to claim 9, wherein said cereal husks is selected from the group consisting of:
rice husks;
wheat husks;
rye husks;
oat husks;
spelt husks; and
a combination thereof.

13. The method according to claim 1, comprising drying said loose material of vegetable origin to a degree of humidity of ≤10%.

14. The method according to claim 1, wherein said loose material of vegetable origin comprises a mixture of at least two of the following loose products:
a loose product obtained from raw material based on ground coconut;
a loose product obtained from raw material based on cork;
rachis of cereal ear; and
cereal husks.

15. The method according to claim 1, wherein said loose product obtained from raw material based on ground coconut comprises the only fibrous part of a starting product based on coconut.

16. The method according to claim 14, wherein said loose product obtained from raw material based on ground coconut is obtained by subjecting said starting product based on coconut to a separation step configured to divide a powder part having a granulometry less than 500 μm, which is discharged, from a fibrous part, having a granulometry greater than 500 μm which is utilized.

17. The method according to claim 15, wherein said separation step is carried out by a vibrating sieve.

18. The method according to claim 15, wherein said during said separation step the humidity is adjusted in such a way that the humidity value is less than, or equal to 10%.

* * * * *